US009138789B2

(12) United States Patent
Grüss et al.

(10) Patent No.: US 9,138,789 B2
(45) Date of Patent: Sep. 22, 2015

(54) METHOD FOR ADJUSTING A DRIVE LOAD FOR A PLURALITY OF DRIVES OF A MILL TRAIN FOR ROLLING ROLLING STOCK, CONTROL AND/OR REGULATION DEVICE, STORAGE MEDIUM, PROGRAM CODE AND ROLLING MILL

(75) Inventors: Ansgar Grüss, Erlangen (DE); Bernd Linzer, Linz (AT); Alois Seilinger, Linz (AT)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 1178 days.

(21) Appl. No.: 13/127,094

(22) PCT Filed: Oct. 22, 2009

(86) PCT No.: PCT/EP2009/063859

§ 371 (c)(1),
(2), (4) Date: Jun. 14, 2011

(87) PCT Pub. No.: WO2010/049338

PCT Pub. Date: May 6, 2010

(65) Prior Publication Data

US 2011/0239722 A1 Oct. 6, 2011

(30) Foreign Application Priority Data

Oct. 30, 2008 (EP) ..... 08018950

(51) Int. Cl.

| | |
|---|---|
| ***B21B 37/46*** | (2006.01) |
| ***B21B 35/04*** | (2006.01) |
| *B21B 1/46* | (2006.01) |

(52) U.S. Cl.

CPC ..... *B21B 37/46* (2013.01); *B21B 35/04* (2013.01); *B21B 1/463* (2013.01); *B21B 2275/06* (2013.01)

(58) Field of Classification Search

CPC ..... B21B 37/46; B21B 35/04; B21B 1/463; B21B 2275/06

USPC ..... 72/7.5, 8.8, 9.2, 11.5, 11.8, 234, 240, 72/248, 365.2; 700/146–155; 29/527.7, 29/33 C; 164/413, 417, 451, 476, 477

See application file for complete search history.

(56) References Cited

U.S. PATENT DOCUMENTS

| | | | | |
|---|---|---|---|---|
| 3,353,384 | A | 11/1967 | Per et al. | 72/13.2 |
| 3,787,587 | A | 1/1974 | King et al. | 235/151.1 |

(Continued)

FOREIGN PATENT DOCUMENTS

| | | | | |
|---|---|---|---|---|
| CN | 1211476 | A | 3/1999 | B21B 37/16 |
| DE | 1438856 | A1 | 4/1969 | B21B 37/46 |

(Continued)

OTHER PUBLICATIONS

Korean Office Action, Application No. 1020117012136, 9 pages, Jul. 3, 2014.

(Continued)

*Primary Examiner* — Shelley Self
*Assistant Examiner* — Pradeep C Battula
(74) *Attorney, Agent, or Firm* — Slayden Grubert Beard PLLC

(57) ABSTRACT

Drive loads for a plurality of drives of a mill train for rolling rolling stock with a plurality of rolling stands each being assigned at least one drive, are adjusted essentially to a first set point value on the basis of operation of the mill train in accordance with a first pass sequence. Redistribution of drive loads is improved, by adjusting the drive loads during the rolling to a second set point value different from the first set point value based on operating the mill train in accordance with a second pass sequence different from the first pass sequence, wherein at least during the adjustment of the second set point values a feed rate of the rolling stock into the mill train is adjusted as a function of a discharge rate of the rolling stock which is arranged upstream of the mill train in the direction of mass flow.

3 Claims, 3 Drawing Sheets

(56) References Cited

U.S. PATENT DOCUMENTS

| | | | | |
|---|---|---|---|---|
| 4,745,556 | A | 5/1988 | Turley | 364/472 |
| 5,513,097 | A * | 4/1996 | Gramckow et al. | 700/48 |
| 6,044,895 | A * | 4/2000 | Kuttner et al. | 164/413 |
| 6,220,068 | B1 * | 4/2001 | Brustle et al. | 72/9.3 |
| 6,240,756 | B1 * | 6/2001 | Tsugeno | 72/8.1 |
| 6,773,522 | B1 | 8/2004 | Bodin et al. | 148/541 |
| 6,973,956 | B2 | 12/2005 | Hohenbichler et al. | 164/476 |
| 7,031,797 | B2 * | 4/2006 | Reinschke et al. | 700/150 |
| 7,086,260 | B2 | 8/2006 | Abi-karam | 72/10.2 |
| 7,987,896 | B2 * | 8/2011 | Schmidt | 164/454 |
| 8,342,232 | B2 | 1/2013 | Shikine et al. | 164/454 |
| 8,459,333 | B2 * | 6/2013 | Kurz et al. | 164/451 |
| 8,596,332 | B2 * | 12/2013 | Shikine et al. | 164/413 |
| 8,676,371 | B2 * | 3/2014 | Botta | 72/10.3 |
| 2006/0156773 | A1 * | 7/2006 | Kurz et al. | 72/8.5 |
| 2009/0272510 | A1 | 11/2009 | Shikine et al. | 164/454 |
| 2011/0239722 | A1 | 10/2011 | Grüss et al. | 72/234 |

FOREIGN PATENT DOCUMENTS

| | | | | |
|---|---|---|---|---|
| DE | 2200293 | | 8/1972 | B21B 37/12 |
| DE | 3721744 | A1 | 1/1988 | B21B 37/00 |
| DE | 19637917 | A1 | 3/1998 | B21B 37/00 |
| DE | 4421005 | B4 | 9/2007 | B21B 37/00 |
| DE | 602004003734 | T2 | 10/2007 | B21B 37/00 |
| EP | 0730916 | A1 | 9/1996 | B21B 37/26 |
| GB | 2193348 | A | 2/1988 | B21B 37/00 |
| JP | 56117811 | A | 9/1981 | B21B 37/00 |
| JP | 5747509 | A | 3/1982 | B21B 1/46 |
| JP | 58138510 | A | 8/1983 | B21B 37/24 |
| JP | 60115317 | A | 6/1985 | B21B 37/00 |
| JP | 60184415 | A | 9/1985 | B21B 37/18 |
| JP | 05177223 | A | 7/1993 | B21B 37/00 |
| JP | 06210338 | A | 8/1994 | B21B 37/18 |
| JP | 08300010 | A | 11/1996 | B21B 15/00 |
| JP | 10137825 | A | 5/1998 | B21B 37/00 |
| KR | 20030004835 | | 1/2003 | B21B 37/58 |
| KR | 20080065306 | A | 7/2008 | B21B 1/46 |
| RU | 2218427 | C2 | 12/2003 | B21B 1/18 |
| RU | 2293618 | C2 | 2/2007 | B21B 1/00 |
| SU | 608574 | A1 | 5/1978 | B21B 37/00 |
| WO | 2010/049338 | A2 | 5/2010 | B21B 35/04 |

OTHER PUBLICATIONS

Buchholz, F.G., "Stichplanoptimierung für das Kalt- und Warmwalzen von Band" Berg- und Hüttenmännische Monatshefte vereinigt mit Montan-Rundschau, 7 pages (w/ Eng. Abstract), Feb. 22, 1983.

Richter, Bernd et al., "Stichplanberechnung und Optimierung für Kaltband-walzwerke," Stahl und Eisen, vol. 115, No. 2, 27 pages (w/ Eng. Translation), Feb. 16, 1995.

ABB Automation Products GmbH, "Technische Anleitung Nr. 7—Dimensionierung eines Atriebssystems," 39 pages (w/ Eng. Abstract), Nov. 30, 2000.

International PCT Search Report with Written Opinion, PCT/EP2009/063859, 12 pages, May 11, 2010.

European Search Report, European Patent Application No. 08018950.9-2302, 5 pages, Feb. 12, 2009.

Japanese Office Action, Application No. 2011533684, 6 pages, Aug. 13, 2013.

Korean Office Action, Application No. 1020117012136, 9 pages, Aug. 28, 2013.

* cited by examiner

METHOD FOR ADJUSTING A DRIVE LOAD FOR A PLURALITY OF DRIVES OF A MILL TRAIN FOR ROLLING ROLLING STOCK, CONTROL AND/OR REGULATION DEVICE, STORAGE MEDIUM, PROGRAM CODE AND ROLLING MILL

CROSS-REFERENCE TO RELATED APPLICATIONS

This application is a U.S. National Stage Application of International Application No. PCT/EP2009/063859 filed Oct. 22, 2009, which designates the United States of America, and claims priority to EP Application No. 08018950.9 filed Oct. 30, 2008. The contents of which are hereby incorporated by reference in their entirety.

TECHNICAL FIELD

The invention relates to a method for adjusting drive loads for a plurality of drives of a mill train for rolling rolling stock, wherein the mill train has a plurality of rolling stands, and each rolling stand is assigned at least one drive for driving the working rolls included in the respective rolling stand, wherein the drive loads are adjusted essentially to a first setpoint value on the basis of operation of the mill train in accordance with a first pass sequence. In addition, the invention relates to an open-loop and/or closed-loop control device for a rolling mill and to a rolling mill. Furthermore, the invention relates to a storage medium and to a machine-readable program code.

The present invention is based on the technical field of rolling plant technology. The rolling of metallic goods is generally used to manufacture semi-finished products which are subsequently used in the metal-processing industry, for example in the automobile industry.

BACKGROUND

A rolling mill must generally be capable of manufacturing a wide variety of metallic semi-finished products which differ, for example, in the metal to be processed, in the joining properties of steel to be processed and the spatial dimensions, in particular the thickness.

In this regard it is necessary for operation of a rolling mill to be capable of being reset in such a way that, for example, strips with a wide variety of properties can be successively fabricated as quickly as possible so that a high equipment throughput rate is achieved. This is necessary both for hot rolling and for cold rolling. Such resetting of the rolling operation also has, in particular, effects on the distribution of the drive loads for the drives of a mill train. The drive loads are dependent on the thickness reductions in the rolling stock which take place at the rolling stands, the temperature of the rolling stock to be rolled, the type of the rolling stock, that is to say for example steel, copper, etc.

Korean laid-open application KR 2003004835-A discloses a method for automatically adjusting a load distribution for a continuously rolling rolling mill. In this document, setpoint values which are to be achieved when the desired discharge thickness is achieved are predefined for the load distribution.

SUMMARY

According to various embodiments an improved method for carrying out redistribution of drive loads in a mill train can be provided, and for this purpose a corresponding open-loop and/or closed-loop control device, a program code, a storage medium and a rolling mill can be made available.

According to an embodiment, in a method for adjusting a drive load for a plurality of drives of a mill train for rolling rolling stock, wherein the mill train has a plurality of rolling stands, and each rolling stand is assigned at least one drive for driving the working rolls included in the respective rolling stand, the drive loads are adjusted essentially to a first setpoint value on the basis of operation of the mill train in accordance with a first pass sequence, and during the rolling the drive loads are adjusted in the direction of a second setpoint value which is based on a second pass sequence which is different from the first pass sequence, wherein at least during the adjustment of the second setpoint values a feed rate of the rolling stock into the mill train is adjusted as a function of a discharge rate of the rolling stock of a unit which is arranged upstream of the mill train in the direction of mass flow.

According to a further embodiment, the rolling stock can be rolled to the same discharge thickness during operation of the mill train according to the first pass sequence and during operation according to the second pass sequence. According to a further embodiment, the method can be carried out chronologically after a transition, performed during the rolling of rolling stock in the mill train, from a first discharge thickness of the mill train to a second discharge thickness, different from the first, of the mill train. According to a further embodiment, the mill train and at least one unit, which is arranged upstream of the mill train in the direction of mass flow, can be coupled in terms of fabrication technology by the rolling stock.

According to another embodiment, a control device for example an open-loop and/or closed-loop control device for a rolling mill may comprise a multi-stand mill train, having a machine-readable program code which has control commands which, when executed, cause the open-loop and/or closed-loop control device to carry out a method as described above.

According to yet another embodiment, a machine-readable program code for an open-loop and/or closed-loop control device for a rolling mill has control commands which cause the open-loop and/or closed-loop control device to carry out the method as described above.

According to yet another embodiment, a storage medium may have a machine-readable program code as described above which is stored thereon.

According to yet another embodiment, a rolling mill may have a multi-stand mill train for rolling, in particular metallic, rolling stock, having an open-loop and/or closed-loop control device as described above, having a device for feeding the discharge rate of the rolling stock of a unit, which is arranged upstream of the mill train in the direction of mass flow, to the open-loop and/or closed-loop control device, wherein the rolling stands of the mill train are operatively connected to the open-loop and/or closed-loop control device.

According to a further embodiment of the rolling mill, the mill train can be embodied as a high reduction mill, which is arranged downstream of a casting unit in the direction of mass flow, and/or a finishing train. According to a further embodiment of the rolling mill, the unit which is arranged upstream may be a casting unit which is embodied as a two-roller casting machine or as an ingot mold.

BRIEF DESCRIPTION OF THE DRAWINGS

Further advantages of the invention emerge from an exemplary embodiment which will be explained in more detail below with reference to the following schematic drawings, in which.

DETAILED DESCRIPTION

Figure 1:
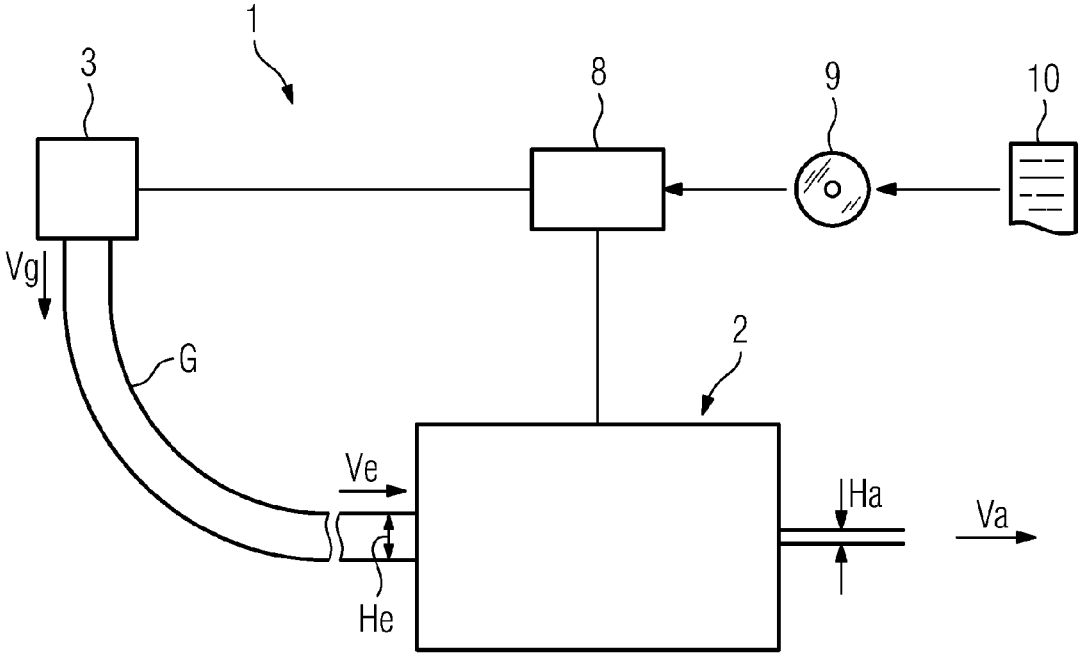
FIG. 1 shows a schematically illustrated ingot-mold-operated casting rolling plant.

The method part of the object is achieved by a method of the type specified at the beginning, wherein during the rolling the drive loads are adjusted in the direction of a second setpoint value which is based on a second pass sequence which is different from the first pass sequence, wherein at least during the adjustment of the second setpoint values a feed rate of the rolling stock into the mill train is adjusted as a function of a discharge rate of the rolling stock of a unit which is arranged upstream of the mill train in the direction of mass flow.

As a rule, the second setpoint value for the drive load for the respective drive is different from the first setpoint value for the drive load of this drive. However, under certain circumstances, some of the drives of the mill train are provided with a second setpoint value which is based on the second pass sequence and which does not differ significantly from the absolute value of the first setpoint value. This is the case in particular in drives for rolling stands which are located at the start of the mill train and, under certain circumstances, are not to experience a change in the drive load.

The feed rate which is to be set serves as a fixed input variable, which cannot be adapted as desired, for the mill train, and said variable is, in particular, not influenced by processes arranged downstream of the first rolling stand of the mill train in the direction of mass flow. Instead, the feed rate of the rolling stock into the mill train is dependent on a discharge rate of the rolling stock of one or more units which are preferably arranged exclusively upstream of the mill train in the direction of mass flow.

An actual discharge rate of the rolling stock of a unit which is arranged upstream of the mill train in the direction of mass flow is preferably used as the discharge rate. Alternatively, a setpoint discharge rate of the rolling stock of a unit which is arranged upstream of the mill train in the direction of mass flow can be used. The discharge rate of that unit of the rolling mill which has the smallest time dynamics is preferably used, and therefore in the case of changes to the process thereof it reacts with more inertia than the other units in the case of process changes occurring at these units. This unit with the smallest time dynamics constitutes as a rule the limitation with respect to the change in the feed rate of the mill train. This is because under certain circumstances said unit can no longer follow, in terms of processing technology, the relatively quickly occurring changes in the feed rate of the mill train. A unit is a device which machines or processes or generates a rolling stock in a rolling mill which has an indirect or direct operative relationship with the mill train.

Examples of this are, for example, a coiler, furnace, rolling stand, casting machine, trimmer, descaler, cooling section, etc.

In previous methods for distributing loads in a mill train, the feed rate has generally been a manipulated variable with which, for example, a reaction is made, for example, to fluctuations in mass flow or fluctuations in strip tension in the mill train, caused by the resetting of the operation of the mill train. This permits the deviations in process variables, for example the mass flow, which are caused by the change in the drive loads, to be corrected.

However, the change in the feed rate is, under certain circumstances, propagated to the units of the mill train which are arranged upstream in the direction of mass flow. Depending on the design of the rolling mill, this can lead to considerable problems in the process control of the processes occurring at the units which are arranged upstream of the mill train in the direction of mass flow. Undesired slowing of processes may occur in order to generate waiting times so as to avoid collisions of rolling stock, for example in the batch operating mode, extending as far as interruptions in processes for units which are arranged upstream of the mill train in the direction of mass flow.

However, this can be avoided according to various embodiments, by determining, setting and maintaining the feed rate of the rolling stock into the mill train in such a way that adaptation of a rolling stock discharge rate of a unit arranged upstream in the direction of mass flow to the feed rate of the mill train is not necessary, or is necessary only to a relatively small degree. In this context, "relatively small degree" means that the process of the unit which is arranged upstream of the mill train in the direction of mass flow is influenced by the change in the feed rate only in such a way that the unit can cope with this influencing of the process and an interruption in the process or process fault does not occur at this unit. In particular, the units which are arranged upstream of the mill train in the direction of mass flow can be operated according to their setpoint values without a correction of the setpoint values, due to processes which are arranged downstream in the direction of mass flow, for instance due to a load redistribution in the mill train, being necessary.

In other words, the mass flow turbulences in the mill train which are caused by the redistribution of the drive loads can be cascaded out completely in the direction of mass flow according to various embodiments. That is to say cascading out counter to the direction of mass flow—as is customary today —is not absolutely necessary.

However, it is also possible to use mixed cascading out of fluctuations in the mass flow in the mill train during the transition in the direction of mass flow and counter to the direction of mass flow. For example, the feed rate of the rolling stock into the mill train is changed during the changing of the drive loads in a reactive way to processes which are arranged upstream in the direction of flow such that said processes can still follow the change in the feed rate into the mill train sufficiently quickly in terms of control technology, i.e. there is no irreversible process disruption of the units arranged upstream in the mill train in the direction of mass flow. For this purpose, in addition to the discharge rate, the chronological dynamics of the slowest-acting unit arranged upstream of the mill train in the direction of mass flow are taken into account, i.e. how quickly and to what extent this unit can react to changes in the process without irreversible process disruptions occurring. Necessary corrections in the mass flow above and beyond this are then cascaded out in the direction of mass flow. This has the advantage that actuator elements in the rear rolling stands are stressed less during redistribution of the drive loads in the case of mixed forward and rearward cascading out of process disruptions in the mill train, since the reduced feed rate of the rolling stock into the mill train also lowers the rolling rate of the rolling stock at the rear rolling stands of the mill train. This may be significant, in particular, for adjustment travel and for the accelerations at the individual rolling stands.

The various embodiments can be applied both to hot rolling and cold rolling of metal strips.

In particular, it is advantageous during the execution of the method according to various embodiments to switch off the automatic gauge control (AGC) temporarily for a respective rolling stand of the mill train in order to avoid incorrect control interventions during the redistribution of the drive loads of the rolling stock.

It is also advantageous that the feed rate is given an essentially constant setting as a function of a discharge rate of the rolling stock of a unit which is arranged upstream of the mill train in the direction of mass flow. In this way, advantages according to various embodiments can also be obtained in a particularly simple manner in particular for slowly changing processes which are arranged upstream of the mill train. This is particularly advantageous in the case of casting rolling plant since the casting rate is generally constant and the casting unit is generally the unit with the smallest chronological dynamics. In particular, this is also advantageous in the case of rolling mills whose units are coupled in terms of fabrication technology to one another by the rolling stock, i.e. the rolling stock is formed in one piece, for example by a casting unit, up to a coiler which coils a warm strip.

In particular, the various embodiments permit a constant mass flow into the rolling mill to be ensured at the input side. This leads to corresponding planning security and smoother sequencing of the processes which are arranged upstream of the mill train in the direction of mass flow.

A pass sequence generally represents the thickness reductions and circumferential speeds of the working rolls for the respective rolling stands of the working rolls. If the reduction in thickness is reset for a rolling stand, the entire pass sequence of the mill train is inevitably changed. It is either necessary to take account of the change in the reduction in thickness at a rolling stand by means of rolling stands which are arranged downstream of the latter, in order to make available a constant discharge thickness out of the mill train, or the change in the pass sequence results in a selective change in the discharge thickness out of the mill train. In both cases, this has a direct effect on the drive loads of the drives which are assigned to the respective rolling stands.

In one embodiment, the rolling stock is rolled to the same discharge thickness during operation of the mill train according to the first pass sequence and during operation according to the second pass sequence. This means that when the rolling process is running the discharge thickness of the rolling stock out of the mill train is maintained by means of the method according to various embodiments, and at the same time the load distribution of the drives for the rolling stands of the mill train can be optimized, without an undesired reaction on units arranged upstream of the mill train in the direction of mass flow.

It is particularly advantageous that the method is carried out chronologically after a transition, performed during the rolling of rolling stock in the mill train, from a first discharge thickness of the mill train to a second discharge thickness of the mill train which is different from the first discharge thickness. Discharge thickness is understood to be the thickness of the rolling stock after the last rolling stand of the mill train, and feed thickness is understood to be the thickness of the rolling stock before the first rolling stand of the mill train. The method is suitable both for a transition from a relatively thin discharge thickness into a thicker discharge thickness and vice versa. During the transition of the rolling stock from a first discharge thickness out of the mill train into a second discharge thickness out of the mill train, which is different from the first, as a rule changes in pass sequences are performed which allow for technical equipment restrictions, for example the avoidance of permanent overloading of the drives. During the changing of the operation of a mill train according to a first pass sequence to operation of the mill train according to a second pass sequence during the rolling, the peripheral conditions are defined differently than in a steady-state operating mode of the mill train, due to disruptions in the mass flow in the mill train.

That is to say the various embodiments can be used particularly advantageously if at first a discharge thickness is used according to a first pass sequence, and then a change in the discharge thickness of the mill train is carried out on the basis of a second pass sequence during the rolling. The second pass sequence is calculated in such a way that an easy transition from the first discharge thickness to the second discharge thickness can take place. If the second discharge thickness is set, a further change in pass sequence preferably takes place immediately in such a way that the drive loads of the drives of the mill train are optimized for the steady-state operating mode of the mill train with the discharge thickness according to the second pass sequence. For this purpose, the second pass sequence is changed into a third pass sequence. In this example, the second pass sequence corresponds to the first pass sequence mentioned in one embodiment, and the third pass sequence corresponds to the second pass sequence mentioned in one embodiment.

In particular, the combination of the "changing the discharge thickness out of the mill train during rolling" method with the subsequent "pass sequence optimization in respect of the drive loads during the rolling with a constant discharge thickness" method increases the operational reliability of the mill and has a positive effect on the service life of the drives.

The method can be used particularly advantageously if the mill train and at least one unit, which is arranged upstream of the mill train in the direction of mass flow, are coupled in terms of fabrication technology by the rolling stock. In this context, the reaction when there is a change in the feed rate into the mill train due to redistribution of the loads of the drives is particularly drastic. The change in the feed rate is transmitted directly to the unit arranged upstream of the mill train in the direction of mass flow by the rolling stock, and the process which occurs at this unit is therefore disrupted.

In particular, if the unit which is arranged upstream in the direction of mass flow is the casting unit, an excessively large or fast change in the feed rate into the mill train can lead to disruptions of the casting process extending as far as interruption of casting. The various embodiments can therefore be used particularly advantageously for a casting rolling plant which is preferably operated in an "endless" operating mode, i.e. casting and rolling are carried out continuously.

According to various embodiments, an open-loop and/or closed-loop control device for a rolling mill which comprises a multi-stand mill train, having a machine-readable program code which has control commands which, when executed, cause the open-loop and/or closed-loop control device to carry out a method as described above.

In addition, according to other embodiments, in a machine-readable program code for an open-loop and/or closed-loop control device for a rolling mill, the program code has control commands which cause the open-loop and/or closed-loop control device to carry out the method as described above.

Furthermore, according to another embodiment, a storage medium has a machine-readable program code as described above which is stored thereon.

Finally, according to yet other embodiments, a rolling mill has a multi-stand mill train for rolling metallic rolling stock, having an open-loop and/or closed-loop control device as described above, having a device for feeding the discharge feed of the rolling stock of a unit, which is arranged upstream of the mill train in the direction of mass flow, to the open-loop and/or closed-loop control device as described above, wherein the rolling stands of the mill train are operatively connected to the open-loop and/or closed-loop control device. A rolling mill is understood here to be any plant which comprises a mill train, preferably for processing metallic rolling stock, in particular also casting rolling plants.

In a further embodiment of the rolling mill, the mill train is a high reduction mill, which is arranged downstream of a casting unit in the direction of mass flow, and/or a finishing train. A high reduction mill is a mill train which comprises in the present case a plurality of stands and which rolls the rolling stock with a large reduction in thickness while said rolling stock is still very hot. It is possible to differentiate here between liquid core reduction and soft core reduction. As a rule, liquid core reduction is not applied in a high reduction mill but soft core reduction of the rolling stock certainly is. In the case of soft core reduction, the core of the rolling stock is already solid but still very soft owing to the high temperature of, for example, 1200° C. to 1300° C. If the rolling stock was still to have a liquid core in the high reduction mill, considerable process disruptions would be expected as a result of the large forces in the high reduction mill. Large decreases in thickness of the rolling stock can be achieved by the high reduction mill with soft core reduction with comparatively small rolling forces. The method according to various embodiments can be advantageously applied for such a multi-stand high reduction mill. Furthermore, the mill train can alternatively or additionally be embodied as a multi-stand finishing train which rolls rolling stock to desired final dimensions.

FIG. 1 is a schematic illustration of a casting rolling plant 1. The latter comprises a schematically illustrated mill train 2, which comprises a plurality of rolling stands.

The method can be used for any desired multi-stand, in particular three-stand, four-stand, five-stand, six-stand and seven-stand, mill trains, and is not restricted in particular to casting rolling plants either.

In addition, FIG. 1 shows a casting unit 3, embodied here as an ingot mold, which casts rolling stock G at a casting rate Vg, which rolling stock G is subsequently rolled in the mill train 2. This rolling stock G is continuously processed, i.e. there is no cutting of slabs or the like. The parts or units of the rolling mill 1 which influence the rolling stock G are coupled to one another in terms of fabrication technology via the rolling stock G. i.e. said parts or units can no longer be operated independently of one another but instead they must as a rule be operated in consideration of the units of the rolling mill 1 which are arranged upstream and downstream in the direction of mass flow, in particular in respect of those units with the smallest chronological dynamics or with the greatest reaction inertia in the case of changes in processes.

The casting unit 3 and the mill train 2, if appropriate further units (not illustrated in FIG. 1) of the casting rolling plant 1 above and beyond the latter, are operatively connected to an open-loop and/or closed-loop control device 8.

The open-loop and/or closed-loop control device 8 is tailored for carrying out an embodiment of the method. For this purpose, machine-readable program code 10 is fed, for example on a storage medium 9, to the open-loop and/or closed-loop control device. The program code 10 comprises control commands which, when executed, cause the open-loop and/or closed-loop control device to carry out the embodiment of the method. The program code is preferably stored on the open-loop and/or closed-loop control device 8 by stored programming so that the latter can be called readily.

In particular, a value for the discharge rate of the rolling stock G out of a unit, for example the casting unit 3, arranged upstream of the mill train in the direction of mass flow can be fed to the open-loop and/or closed-loop control device 8. In the present example, the value for the discharge rate is the casting rate Vg.

FIG. 1 shows a schematically illustrated mill train 2 in operation, wherein the rolling stock G which is cast by the casting unit 3 at the casting rate Vg is rolled from a feed thickness He to a discharge thickness Ha. In this context, the rolling stock G has a feed rate Ve into the mill train 2, and a discharge rate Va out of the mill train 2.

Figure 2:
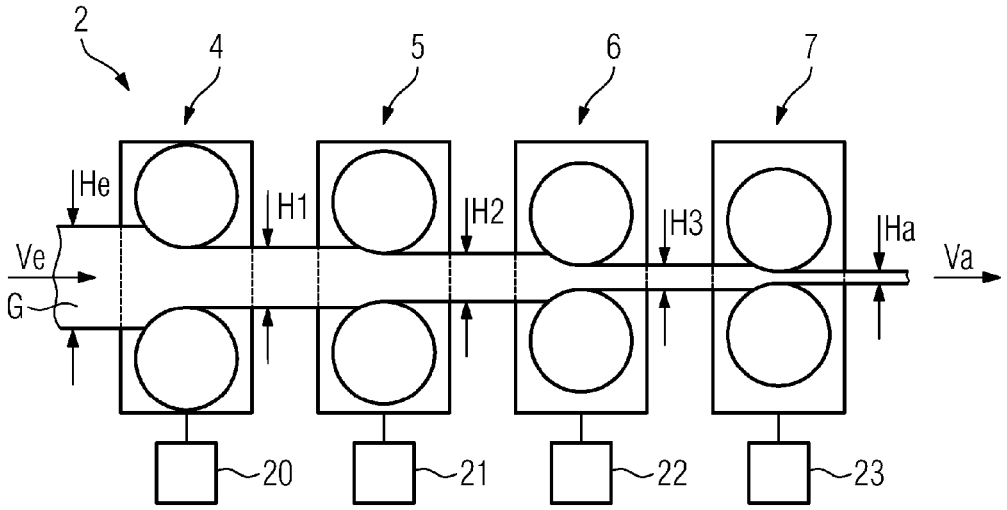
FIG. 2 shows a schematic view of a mill train which has four rolling stands and is operated according to a first pass sequence.
Figure 3:
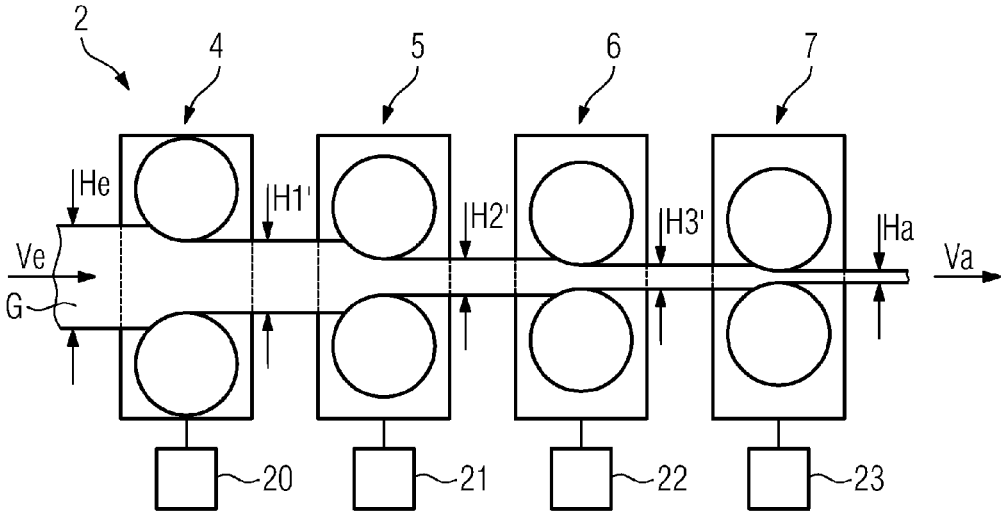
FIG. 3 is a schematic illustration of the mill train from FIG. 2, which is operated according to a second pass sequence.

By means of the method according to various embodiments it is now possible to perform a redistribution of loads of the drives 20, 21, 22 and 23, see FIG. 2 and FIG. 3, driving the rolling stands 4, 5, 6 and 7 respectively, see FIG. 2 and FIG. 3, in such a way that during the rolling of rolling stock G the feed rate Ve and the discharge rate Va remain constant without rolling stock being discarded as a result of the redistribution of the drive loads.

If operation of a mill train 2 is reset from a first discharge thickness Ha to a second discharge thickness Ha which is different from the first discharge thickness, the distribution of the loads of the drives is optimized in such a way that the transition of the rolling operation from the first mill train discharge thickness Ha to a second mill train discharge thickness Ha which is different from the first occurs as far as possible without problems.

However, in this case, the drive loads of the drives 20, 21, 22 and 23 of the mill train 2 are not optimized to a steady-state operating mode of the mill train for the new second mill train discharge thickness but rather to the change, as far as possible without problems, in the discharge thickness Ha out of the mill train 2.

The load distribution of the drives of the mill train 2 is initially not optimal for a steady-state operating mode of the mill train 2 after a flying changeover of the discharge thickness carried out just before then. It is therefore advantageous to redistribute the drive loads of the drives of the mill train 2 after the conclusion of the resetting of the discharge thickness Ha out of the mill train 2 in such a way that there is a small possibility of overloading or other restrictions, wherein the desired discharge thickness is achieved in equal measure, and the steady-state operating mode of the mill train 2 is therefore optimized.

For this purpose, a new optimized pass sequence is initially determined for the steady-state operating mode of the mill train 2. Pass sequence calculations are known in principle, for example from DE 37 21 744 A1 or from DE 44 21 005 B4. The new pass sequence is referred to below as the second pass sequence. That pass sequence according to which the mill train 2 is operated directly after the flying change of the discharge thickness Ha, in order to generate the new discharge thickness Ha, is referred to below as the first pass sequence.

The determination of the second pass sequence entails acquisition of the setpoint values of the drive loads for the drives 20, 21, 22 and 23 of the working rolls of the rolling stands 4, 5, 6 and 7. The second pass sequence is determined in such a way that the desired discharge thickness Ha is achieved and at the same time the drive loads of the drives 20, 21, 22 and 23 of the mill train 2 are optimized, i.e. in particular operated with the greatest possible distance from critical limiting values.

In the present case, the discharge thickness Ha of the mill train 2 remains constant during operation according to the first pass sequence and during operation according to the second pass sequence, i.e. the same discharge thickness out of the mill train 2 is rolled by the drives 20, 21, 22 and 23 of the mill train 2 directly before, during and after the redistribution of the drive loads.

According to various embodiments, when the drive load of the drives 20, 21, 22 and 23 is adjusted, the feed rate Ve of the rolling stock G into the mill train 2 is adjusted as a function of a discharge rate Va of the rolling stock G of a unit 3 which is arranged upstream of the mill train 2 in the direction of mass flow. This ensures that during the resetting of the drive loads of the drives 20, 21, 22 and 23 of the mill train 2, the processes of the units, for example the casting unit 3, which are arranged upstream of the mill train 2 in the direction of mass flow are not disrupted.

The feed rate Ve into the mill train 2 is preferably kept constant during the redistribution of the drive loads of the drives 20, 21, 22 and 23 in the mill train 2. As a rule, the mass flow through the casting rolling plant 1 is constant since as a rule attempts are made to keep the casting rate Vg of the casting unit 3 constant. For this reason, such an embodiment of the solution is technically simple.

In order to utilize this advantage, it is particularly advantageous also to set the feed rate Ve of the rolling stock G into the mill train 2 to a constant value whose absolute value is determined as a function of the casting rate Vg of the casting unit 3. This ensures in a simple way that the processes which are arranged upstream of the mill train 2 in the direction of mass flow are not disrupted.

During the redistribution of the drive loads for the drives 20, 21, 22 and 23 of the mill train 2 there is as a rule also a redistribution of the decrease in thickness at the respective rolling stands 4, 5, 6 and 7 of the mill train 2.

As a rule this entails a thickness wedge which comes about as a result of a change in the discharge thickness H1, H2, H3—see FIGS. 2 and 3—during the rolling.

Before the redistribution of the drive loads of the drives 20, 21, 22 and 23 is carried out, a redistribution section of the rolling stock G, during whose rolling the redistribution of the drive loads of the respective drives 20, 21, 22 and 23 of the mill train 2 takes place in the respective rolling stand 4, 5, 6 or 7, is therefore identified. During the rolling of the redistribution section, the drive loads are each changed from their actual value in the direction of their new setpoint value according to a second pass sequence. This is preferably done as soon as the redistribution section runs into the respective rolling stand 4, 5, 6 or 7. The corresponding setpoint values of the drive loads are achieved when the redistribution section runs out of the respective rolling stand 4, 5, 6 or 7.

During the entire drive load redistribution process of the drives 20, 21, 22 and 23 of the mill train 2, the redistribution section preferably has a length which is not greater than the distance between two rolling stands of the mill train 2 from one another. As a result, the redistribution of the drive loads is possible in a particularly simple way since the thickness wedge of the rolling stock G which is present during the redistribution is not rolled simultaneously in two rolling stands 4, 5, 6 and 7.

The discharge thickness Ha remains constant during the entire redistribution of the loads of the drives 20, 21, 22 and 23. That is to say the disruptions in mass flow which are caused by the redistribution of the drive loads are compensated by at least one downstream rolling stand 4, 5 or 7 in such a way that the desired discharge thickness Ha is maintained.

FIG. 2 and FIG. 3 show the same mill train 2, having the rolling stands 4, 5, 6 and 7, to which the drives 20, 21, 22 and 23 are assigned.

The drives 20, 21, 22 and 23 serve to drive the working rolls (not denoted in more detail) of the rolling stands 4, 5, 6 and 7 of the mill train 2. The drives 20, 21, 22 and 23 have a corresponding drive load applied to them so that a desired decrease in thickness is achieved at the respective rolling stand 4, 5, 6 or 7, or a desired rolling performance is achieved at the respective rolling stand 4, 5, 6 or 7. In FIG. 2, the mill train 2 is operated according to a first pass sequence. In FIG. 3, the same mill train 2 is operated according to a second pass sequence. The discharge thickness Ha out of the mill train 2 is the same in both cases.

The operation of the mill train 2 in FIG. 2 and FIG. 3 differs only in that different decreases in thickness take place for the mill stands 4, 5 and 6 during operation of the mill train 2 according to a first pass sequence and during operation of the mill train 2 according to a second pass sequence.

While the rolling stand 4 rolls the rolling stock G from a rolling stock thickness He to a rolling stock thickness H1 according to a first pass sequence, i.e. according to FIG. 2, the same rolling stand rolls the rolling stock G from a thickness He to a thickness H1' during operation of the mill train 2 according to the second pass sequence. In the present case, the thickness H1' is not equal to the thickness H1. The thickness H1' is selected here in such a way that the drive load of the drives 20 which are assigned to the rolling stand 4 is improved compared with operation according to the first pass sequence.

The same occurs at the rolling stand 5, which rolls the rolling stock from a rolling stock thickness H1 to a rolling stock thickness H2 according to the first pass sequence, i.e. according to FIG. 2. According to the second pass sequence, the same rolling stand 5 rolls a discharge thickness H2' starting from an inflow-end rolling stock thickness H1' at the second rolling stand 5. The thickness H2' is also determined here such that the drive load of the drives 20 which are assigned to the rolling stand 4 is improved compared with the operation according to the first pass sequence.

The same occurs at the rolling stand 6, which rolls the rolling stock from a rolling stock thickness H2 to a rolling stock thickness H3 according to the first pass sequence, i.e. according to FIG. 2. According to the second pass sequence, the same rolling stand 6 rolls a discharge thickness H3' starting from an inflow-end rolling stock thickness H2' at the third rolling stand 6 of the mill train 2.

For example, the sum of the distances between the drives of the mill train from critical limiting values can be minimized as an optimization criterion for the drive loads of the drives of the mill train 2, wherein a corresponding discharge thickness Ha out of the mill train 2 is achieved.

Redistribution of the drive load and an associated change in the decrease in thickness does not necessarily have to take place at each rolling stand. The redistribution of the drive loads can also occur for just some of the rolling stands or of the drives which are assigned to the rolling stands.

The individual rolling stands are successively reset according to the second pass sequence, specifically whenever the redistribution section runs through the respective rolling stand.

In FIG. 3, the decrease in thickness at the rolling stands is set in such a way that the discharge thickness Ha is achieved and at the same time the distance between the setpoint values of the drive loads of the individual drives from limiting values which are not to be exceeded or undershot in the steady-state operating mode achieves its maximum.

Figure 4:
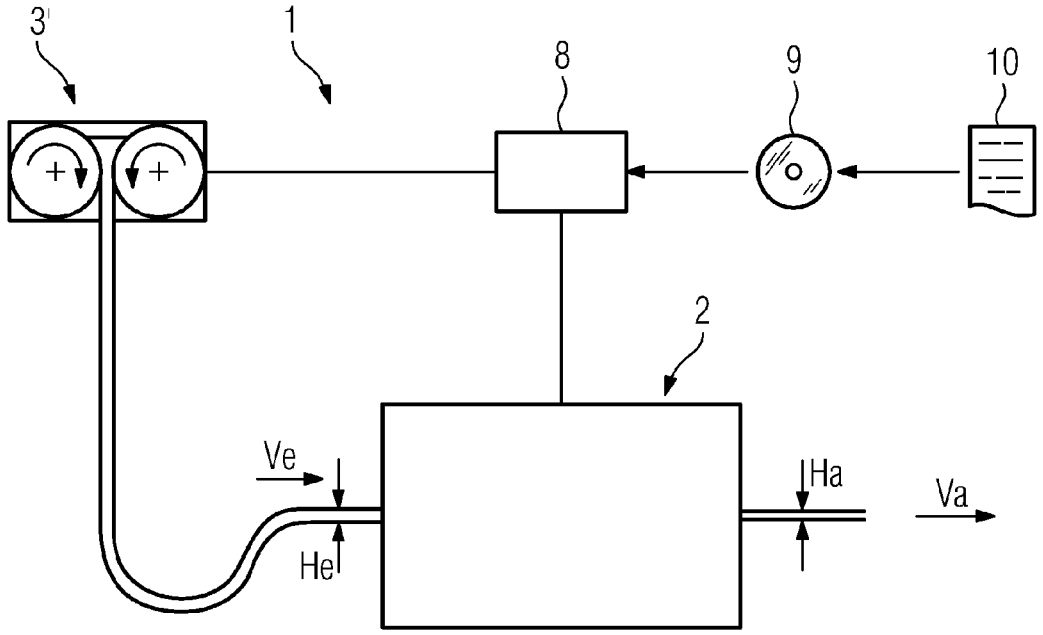
FIG. 4 is a schematic illustration of a casting rolling plant which comprises a two-roller casting machine.

FIG. 4 shows a further embodiment for a casting rolling plant 1 comprising a two-roller casting machine 3', wherein the cast rolling stock G subsequently runs through a multi-stand, i.e. at least two-stand, mill train 2.

Rolling stock G is as a rule produced in an endless operating mode by means of a two-roller casting machine 3'. With this type of plant it is advantageous that it is even more compact than a plant which has endless operation and casts by means of an ingot mold. In addition, the consumption of energy and resources is reduced further. The compactness and the reduced use of resources results from the fact that by means of a two-roller casting machine 3' it is possible to cast more closely to the final dimensions of the desired end product. That is to say the rolling stock which emerges from the two-roller casting machine G' is as a rule already significantly thinner than the rolling stock G which emerges from an ingot mold, cf. FIG. 1. As a result it is possible for a roughing train or high reduction mill, which is as a rule arranged downstream of an ingot-mold-operated casting machine, to be dispensed with. The latter serves to prepare rolling stock which is cast out of the ingot mold for finishing. In contrast, with a two-roller casting machine there is generally no need for such shaping preparation but rather all that is then required is finishing of the rolling stock G in the mill train 2.

In this case it may also be desirable to perform load redistribution for the rolling stands (not illustrated in FIG. 4) of the mill train in the on-going operating mode.

In order to implement this, the statements relating to FIGS. 1 to 3 apply analogously to a rolling mill 1 which includes a two-roller casting machine 6'.

What is claimed is:

1. A method for adjusting a drive load for a plurality of drives of a mill train for rolling a rolling stock, wherein the mill train has a plurality of rolling stands, and each rolling stand is assigned at least one drive for driving the working rolls included in the respective rolling stand, the method comprising:

during a first pass sequence, operating the plurality of drives of the mill train to provide drive loads for the plurality of drives based on a first setpoint value, the drive loads provided by the plurality of drives during the first pass sequence reducing a thickness of the rolling stock to a first discharge thickness, drive loads for the plurality of drives based on a first setpoint value during the rolling, adjusting the drive loads from the first setpoint value in the direction of a second setpoint value for a second pass sequence which is different from the first pass sequence, the drive loads provided by the plurality of drives during the second pass sequence reducing the thickness of the rolling stock to a second discharge thickness, during the second pass sequence, operating the plurality of drives of the mill train to provide drive loads for the plurality of drives based on the second setpoint value, and at least during the adjustment of the drive loads from the first setpoint value in the direction of the second setpoint values, adjusting a feed rate of the rolling stock into the mill train as a function of a discharge rate of the rolling stock from a unit which is arranged upstream of the mill train in the direction of mass flow, such that the discharge rate of the rolling stock from the unit upstream of the mill train is not affected by the adjustment of the drive loads from the first setpoint value in the direction of the second setpoint values.

2. The method according to claim 1, wherein the first discharge thickness resulting from operation of the mill train according to the first pass sequence is the same as the second discharge thickness resulting from operation of the mill train according to the second pass sequence.

3. The method according to claim 1, wherein the method is carried out chronologically after a transition, performed during the rolling of rolling stock in the mill train, from a first discharge thickness of the mill train to a second discharge thickness, different from the first, of the mill train.

* * * * *